US006500329B2

(12) United States Patent
Tsao et al.

(10) Patent No.: US 6,500,329 B2
(45) Date of Patent: Dec. 31, 2002

(54) SELECTIVE RING OPENING PROCESS FOR PRODUCING DIESEL FUEL WITH INCREASED CETANE NUMBER

(75) Inventors: Ying-Yen P. Tsao, Bryn Mawr, PA (US); Tracy J. Huang, Princeton, NJ (US); Philip J. Angevine, Woodbury, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/981,575

(22) Filed: Oct. 16, 2001

(65) Prior Publication Data

US 2002/0121457 A1 Sep. 5, 2002

Related U.S. Application Data

(63) Continuation-in-part of application No. 09/859,112, filed on May 16, 2001, now abandoned, which is a continuation of application No. 09/330,386, filed on Jun. 11, 1999, now Pat. No. 6,241,876, which is a continuation-in-part of application No. 09/222,977, filed on Dec. 30, 1998, now Pat. No. 6,210,563.

(51) Int. Cl.[7] ..... C10G 65/02; C10G 35/085

(52) U.S. Cl. ..... 208/59; 208/58; 208/15; 208/137; 208/111.01; 208/111.35; 208/134; 208/135; 208/138; 208/143; 208/144; 208/145; 585/266; 585/269

(58) Field of Search ..... 208/58, 59, 15, 208/137, 111.01, 111.35, 134, 135, 138, 143, 144, 145; 585/266, 269

(56) References Cited

U.S. PATENT DOCUMENTS

| | | | | |
|---|---|---|---|---|
| 4,494,961 | A | 1/1985 | Venkat et al. | 44/57 |
| 4,610,779 | A | 9/1986 | Markley et al. | 208/212 |
| 4,676,885 | A | 6/1987 | Bush | 208/49 |
| 4,676,887 | A | 6/1987 | Fischer et al. | 208/61 |
| 4,803,185 | A | 2/1989 | Miller et al. | 502/65 |
| 4,820,402 | A | 4/1989 | Partridge et al. | 208/111 |
| 4,840,930 | A | 6/1989 | LaPierre et al. | 502/79 |
| 4,882,307 | A | 11/1989 | Tsao | 502/66 |
| 4,889,616 | A | 12/1989 | Miller et al. | 208/111 |
| 4,960,505 | A | 10/1990 | Milderhound et al. | 208/143 |
| 5,037,531 | A | 8/1991 | Bundens et al. | 208/120 |
| 5,041,401 | A | 8/1991 | Schoennagel et al. | 501/61 |
| 5,139,647 | A | 8/1992 | Miller | 208/100 |
| 5,147,526 | A | 9/1992 | Kukes et al. | 208/111 |
| 5,171,422 | A | 12/1992 | Kirker et al. | 208/111 |
| 5,183,556 | A | 2/1993 | Reilly et al. | 208/57 |
| 5,183,557 | A | 2/1993 | Degnan, Jr. et al. | 208/111 |
| 5,219,814 | A | 6/1993 | Kirker et al. | 502/66 |
| 5,284,985 | A | 2/1994 | Girgis et al. | 585/310 |
| 5,290,744 | A | 3/1994 | Degnan, Jr. et al. | 502/67 |
| 5,364,997 | A | 11/1994 | Girgis et al. | 585/23 |
| 5,382,730 | A | 1/1995 | Breckenridge et al. | 585/310 |
| 5,384,296 | A | 1/1995 | Tsao | 502/66 |
| 5,391,291 | A | 2/1995 | Winquist et al. | 208/143 |
| 5,401,389 | A | 3/1995 | Mazzone et al. | 208/89 |
| 5,451,312 | A | 9/1995 | Apelian et al. | 208/143 |
| 5,463,155 | A | 10/1995 | Galperin et al. | 585/310 |
| 5,520,799 | A | 5/1996 | Brown et al. | 208/143 |
| 5,583,276 | A | 12/1996 | Hellring et al. | 585/722 |
| 5,609,752 | A | 3/1997 | Del Rossi et al. | 208/144 |
| 5,611,912 | A | 3/1997 | Han et al. | 208/58 |
| 5,763,731 | A | 6/1998 | McVicker et al. | 585/731 |
| 5,831,139 | A | 11/1998 | Schmidt et al. | 585/315 |
| 5,865,985 | A | 2/1999 | Desai et al. | 208/57 |
| 5,882,505 | A | 3/1999 | Wittenbrink et al. | 208/59 |
| 5,888,376 | A | 3/1999 | Wittenbrink et al. | 208/59 |

*Primary Examiner*—Nadine G. Norton
(74) *Attorney, Agent, or Firm*—Erika Singleton Wilson; Gerard J. Hughes

(57) ABSTRACT

A two stage process useful for cetane upgrading of diesel fuels. More particularly, the invention relates to a process for selective naphthenic ring-opening utilizing an extremely low acidic distillate selective catalyst having highly dispersed Pt. The process is a two stage process wherein the first stage is a hydrotreating stage for removing sulfur from the feed and the second stage is the selective ring-opening stage.

20 Claims, 7 Drawing Sheets

$T_{90}$ Reduction and Reaction Temperature vs. $H_2$ Consumption
Feed
T of 400°F Liquid
750
740
730
720
710
700
690
680
670
660
Reaction Temperature, °F
660
640
620
600
580
560
540
0
50
100
150
200
250
300
350
400
450
500
$H_2$ Consumption, scf/bbl Two Stage Hydrotreating/Selective Ring Opening Process

SELECTIVE RING OPENING PROCESS FOR PRODUCING DIESEL FUEL WITH INCREASED CETANE NUMBER

CROSS REFERENCE TO RELATED APPLICATIONS

The present application is a continuation-in-part of U.S. Pat. application Ser. No. 09/859,112 filed May 16, 2001 now abandoned; which is a continuation of U.S. patent application Ser. No. 09/330,386 filed Jun. 11, 1999, now U.S. Pat. No. 6,241,876; which was a continuation-in-part of U.S. patent application Ser. No. 09/222,977 filed on Dec. 30, 1998, now U.S. Pat. No. 6,210,563.

BACKGROUND OF THE INVENTION

1. Field of the Invention

The present invention relates to a two stage process useful for cetane upgrading of diesel fuels. More particularly, the invention relates to a process for selective naphthenic ring-opening utilizing an extremely low acidic distillate selective catalyst having highly dispersed Pt. The process is a two stage process wherein the first stage is a hydrotreating stage for removing sulfur from the feed and the second stage is the selective ring-opening stage.

2. Description of Prior Art

Under present conditions, petroleum refineries are finding it increasingly necessary to seek the most cost-effective means of improving the quality of diesel fuel products. Cetane number is a measure of ignition quality of diesel fuels. Cetane number is highly dependent on the paraffinicity of molecular structures whether they be straight chain or alkyl attachments to rings. Distillate aromatic content is inversely proportional to cetane number while a high paraffinic content is directly proportional to a high cetane number.

Currently, diesel fuels have a minimum cetane number of 45. But the European Union (EU) just passed an amendment requiring that the cetane number of European diesel fuels reach 51 by the year 2000, even higher cetane numbers of at least 58 are being proposed for the year 2005 and beyond.

Aromatic compounds are a high source of octane, but they are poor for high cetane numbers. Aromatic saturation, which can be described as the hydrogenation of aromatic compounds to naphthene rings, has been commonly used to upgrade the cetane level of diesel fuels. However, aromatic saturation can only make low cetane naphthenic species, not high cetane components such as normal paraffins and iso paraffins. As a result, the use of a hydrocracking catalyst for the ring-opening of naphthenic species had been used to solve this problem.

Conventional hydrocracking catalysts that open naphthenic rings rely on high acidity to catalyze this reaction. Because hydrocracking with a highly acidic catalyst breaks both carbon-carbon and carbon-hydrogen bonds, the use of such a catalyst cannot be selective in just opening rings of naphthenic species without cracking desired paraffins for the diesel product.

Furthermore, commercial hydrocracking catalysts rely on acidity as the active ring-opening site, and this active site also catalyzes increased hydroisomerization of the resulting naphthenes and paraffins. It is typical for a cumulative loss of 18–20 cetane numbers for each methyl branching increase. The use of a low acidic catalyst would minimize diesel yield loss, the production of isoparaffins, and the production of gaseous by-products.

Hydroprocessing can be done in a co-current, counter-current or an ebullated bed configuration. In a conventional co-current catalytic hydroprocessing, a hydrocarbon feed is initially hydrotreated to help get rid of heteroatom-containing impurities. These heteroatoms, principally nitrogen and sulfur, are converted by hydrodenitrogenation and hydrodesulfurization reactions from organic compounds to their inorganic forms ($H_2S$ and $NH_3$). These inorganic gases inhibit the activity and performance of hydroprocessing catalysts through competitive adsorption on the catalyst. Therefore, the catalyst containing portion of a conventional co-current reactor is often limited in reactivity because of low $H_2$ pressure and the presence of high concentrations of heteroatom components.

Conventional counter-current configurations utilizes a device that creates a flow of hydrogen containing gas within a container in order to force the gaseous phase to flow counter to the liquid phase. U.S. Pat. No. 5,888,376 discloses a counter current process for converting light oil to jet fuel by first hydrotreating the light oil and then flowing the product stream counter-current to upflowing hydrogen containing gas in the presence of hydroisomerization catalysts. These hydroisomerizaton catalysts are highly acidic catalysts. U.S. Pat. No. 5,882,505 also discloses hydroisomerizing wax feedstocks to lubricants in a reaction zone containing an acidic hydroisomerization catalyst in the presence of a hydrogen-containing gas. U.S. Pat. No. 3,767,562 discloses making jet fuel by using a hydrogenation catalyst in a counter-current configuration. None of the counter-current methods in the prior art discloses the use of a catalyst that can selectively open naphthenic species without cracking desired paraffins.

In light of the disadvantages of the conventional processes for improving diesel fuel, there remains a need for a process of selective naphthenic ring-opening that produces an increased cetane number of diesel fuel without a corresponding diesel yield loss.

SUMMARY OF THE INVENTION

In accordance with the present invention, a process is provided for selective ring-opening of naphthenes catalyzed by a low acid catalyst in order to increase diesel fuel yield and cetane number.

In the process, a hydrocarbon feed is contacted with a hydrogen containing gas under superatmospheric conditions with a selective ring-opening (SRO) catalyst. Ideally, the process operates in a counter-current configuration in order to remove gaseous heteroatoms. In the counter-current configuration, the catalyst can operate at lower temperatures in order to minimize hydrocracking and hydroisomerization of paraffin, thereby increasing cetane number and diesel yield. The selective ring-opening catalyst preferably has a crystalline molecular sieve material component and a Group VIII noble metal component. The crystalline molecular sieve material component is a large pore faujasite structure having an alpha acidity of less than 1, preferably less than 0.3. Zeolite USY is the preferred crystalline molecular sieve material component.

The Group VIII noble metal component can be platinum, palladium, iridium, rhodium, or a combination thereof. Platinum is preferred. The content of Group VIII noble metal component can vary. The preferred range is between 0.1 and 5% by weight of the catalyst.

The Group VIII noble metal component is located within the dispersed clusters. In the preferred embodiment, the particle size of Group VIII metal on the catalyst is less than about 10 Å. Dispersion of the metal can also be measured by hydrogen chemisorption techniques in terms of the H/metal ratio. In the preferred embodiment, when platinum is used as the noble metal component, the H/Pt ratio is between about 1.1 and 1.5.

The advantages of the present invention is that (1) it allows selective ring opening of naphthene rings by the use of a low acid catalyst in addition to hydrogenating aromatics and cracking heavy paraffins, and (2) it allows the low acid catalyst to operate at the lowest possible temperature by using a counter-current configuration in order to prevent undesired hydrocracking and hydroisomerization.

For a better understanding of the present invention, together with other and further advantages, reference is made to the following description, taken in conjunction with accompanying drawings, and its scope will be pointed out in the appended claims.

BRIEF DESCRIPTION OF THE DRAWINGS

FIG. 1 is a graph showing conversion vs. reactor temperature.

FIG. 2 is a graph showing product yield vs. cracking severity.

FIG. 3 is a graph showing $T_{90}$ of 400° F.$^+$ diesel products.

FIG. 4 is a graph showing $T_{90}$ go reduction and reaction temperature v. $H_2$ consumption.

FIG. 5 is a graph showing 400° F.$^+$ product cetane vs. cracking severity.

FIG. 6 is a graph showing $T_{90}$ reduction and $H_2$ consumption vs. gas make.

DETAILED DESCRIPTION OF INVENTION

Figure 1:
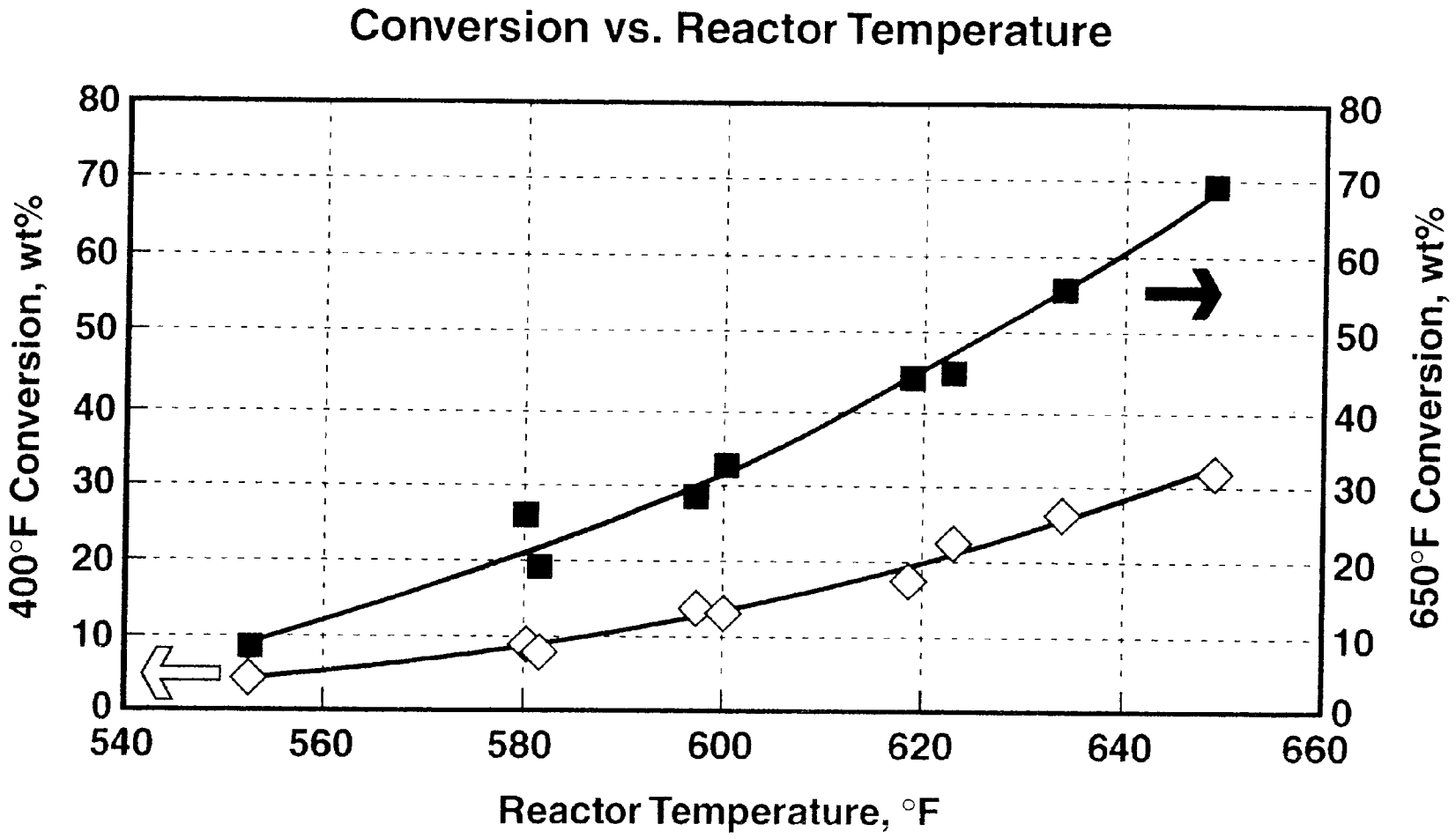
FIGS. 1–6 are graphs showing data obtained for a process within the scope of the invention.

The inventive process uses novel low acidic catalysts for selective ring opening (SRO) of naphthenic species with minimal cracking of paraffins. The SRO catalyst operates at its lowest possible temperature using a counter-current configuration thereby preventing unwanted hydrocracking and hydroisomerization of paraffins. Consequently, the process of the invention provides enhanced cetane levels while retaining a high diesel fuel yield.

The diesel fuel product will have a boiling point range of about 350° F. (about 175° C.) to about 650° F. (about 345 ° C.). The inventive process can be used to either upgrade a feedstock within the diesel fuel boiling point range to a high cetane diesel fuel or can be used to reduce higher boiling point feeds to a high cetane diesel fuel. A high cetane diesel fuel is defined as diesel fuel having a cetane number of at least 50.

Cetane number is calculated by using either the standard ASTM engine test or NMR analysis. Although cetane number and cetane index have both been used in the past as measures of the ignition quality of diesel fuels, they should not be used interchangeably. Cetane index can frequently over-estimate the quality of diesel fuel streams derived from hydroprocessing. Thus, cetane number is used herein.

The catalysts used in the process are described in co-pending application 125-486. The catalysts consist of a large pore crystalline molecular sieve component with a faujasite structure and an alpha acidity of less than 1,preferably 0.3 or less. The catalysts also contain a noble metal component. The noble metal component is selected from the noble metals within Group VIII of the Periodic Table.

Unlike hydrocracking processes, the present invention does not rely on catalyst acidity to drive the opening of naphthenic rings. The process of the invention is driven by the Group VIII noble metal component which acts as a hydrogenation/SRO component. The crystalline molecular sieve material acts as a host for the Group VIII noble metal. The ultra-low acidity permits the cracking of only carbon-carbon bonds without secondary cracking and hydroisomerization of desired paraffins for diesel fuel. Therefore, the lower the acidity value, the higher the cetane levels and the diesel fuel yield. Also, this particular crystalline sieve material helps create the reactant selectivity of the hydrocracking process due to its preference for adsorbing aromatic hydrocarbon and naphthenic structures as opposed to paraffins. Thus the catalyst of the inventive process catalyzes the hydrogenation of aromatics to naphthenes as well as selective ring opening of the naphthenic rings. This preference of the catalyst for ringed structures allows the paraffins to pass through with minimal hydrocracking and hydroisomerization, thereby retaining a high cetane level.

Constraint Index (CI) is a convenient measure of the extent to which a crystalline sieve material allows molecules of varying sizes access to its internal structure. Materials which provide highly restricted access to and egress from its internal structure have a high value for the Constraint Index and small pore size, e.g. less than 5 angstroms. On the other hand, materials which provide relatively free access to the internal porous crystalline sieve structure have a low value for the Constraint Index, and usually pores of large size, e.g. greater than 7 angstroms. The method by which Constraint Index is determined is described fully in U.S. Pat. No. 4,016,218, incorporated herein by reference.

The Constraint Index (CI) is calculated as follows:

$$\text{Constraint Index} = \log_{10}(\text{fraction of n-hexane remaining})\ \log_{10}(\text{fraction of 3-methylpentane remaining}) \quad (1)$$

Large pore crystalline sieve materials are typically defined as having a Constraint Index of 2 or less. Crystalline sieve materials having a Constraint Index of 2–12 are generally regarded to be medium size zeolites.

The SRO catalysts utilized in the process of the invention contain a large pore crystalline molecular sieve material component with a Constraint Index less than 2. Such materials are well known to the art and have a pore size sufficiently large to admit the vast majority of components normally found in a feedstock. The materials generally have a pore size greater than 7 Angstroms and are represented by zeolites having a structure of e.g., Zeolite beta, Zeolite Y, Ultrastable Y (USY), Dealuminized Y (DEALY), Mordenite, ZSM-3,ZSM-4, ZSM- 18 and ZSM-20.

The large pore crystalline sieve materials useful for the process of the invention are of the faujasite structure. Within the ranges specified above, crystalline sieve materials useful for the process of the invention can be zeolite Y or zeolite USY. Zeolite USY is preferred.

The above-described Constraint Index provides a definition of those crystalline sieve materials which are particularly useful in the present process. The very nature of this parameter and the recited technique by which it is determined, however, all ow the possibility that a given zeolite can be tested under somewhat different conditions and thereby exhibit different Constraint Indices. This explains the range of Constraint Indices for some materials. Accordingly, it is understood to those skilled in the art that the CI, as utilized herein, while affording a highly useful means for characterizing the zeolites of interest, is an approximate parameter. However, in all instances, at a temperature within the above-specified range of 290° C. to about 538° C., the CI will have a value for any given crystalline molecular sieve material of particular interest herein of 2 or less.

It is sometimes possible to judge from a known crystalline structure whether a sufficient pore size exists. Pore windows are formed by rings of silicon and aluminum atoms. 12-membered rings are preferred in the catalyst of the invention in order to be sufficiently large to admit the components normally found in a feedstock. Such a pore size is also sufficiently large to allow paraffinic materials to pass through.

The crystalline molecular sieve material utilized in the SRO catalyst has a hydrocarbon sorption capacity for n-hexane of at least about 5 percent. The hydrocarbon sorption capacity of a zeolite is determined by measuring its sorption at 25° C. and at 40 mm Hg (5333 Pa) hydrocarbon pressure in an inert carrier such as helium. The sorption test is conveniently carried out in a thermogravimetric analysis (TGA) with helium as a carrier gas flowing over the zeolite at 25° C. The hydrocarbon of interest, e.g., n-hexane, is introduced into the gas stream adjusted to 40 mm Hg hydrocarbon pressure and the hydrocarbon uptake, measured as an increase in zeolite weight, is recorded. The sorption capacity may then be calculated as a percentage in accordance with the relationship:

The catalyst used in the process of the invention contains a Group VIII noble metal component. This metal component acts to catalyze both hydrogenation of aromatics and the carbon-carbon bond cracking of the SRO of naphthenic species within the feedstock. Suitable noble metal components include platinum, palladium, iridium and rhodium, or a combination thereof. Platinum is preferred. The hydrocracking process is driven by the affinity of the aromatic and naphthenic hydrocarbon molecules to the Group VIII noble metal component supported on the inside of the highly siliceous faujasite crystalline sieve material.

The amount of the Group VIII noble metal component can range from about 0.01 to about 5% by weight and is normally from about 0.1 to about 3% by weight, preferably about 0.3 to about 2 wt %. The precise amount will, of course, vary with the nature of the component. Less of the highly active noble metals, particularly platinum, is required than of less active metals. Because the hydrocracking reaction is metal catalyzed, it is preferred that a larger volume of the metal be incorporated into the catalyst.

Applicants have discovered that highly dispersed Group VIII noble metal particles acting as the hydrogenation/SRO component reside on severely dealuminated crystalline molecular sieve material. The dispersion of the noble metal, such as Pt (platinum), can be measured by the cluster size of the noble metal component. The cluster of noble metal particles within the catalyst should be less than 10 Å. For platinum, a cluster size of about 10 Å would be about 30–40 atoms. This smaller particle size and greater dispersion provides a greater surface area for the hydrocarbon to contact the hydrogenating/SRO Group VIII noble metal component.

The dispersion of the noble metal can also be measured by the hydrogen chemisorption technique. This technique is well known in the art and is described in J. R. Anderson, Structure of Metallic Catalysts, Academic Press, London, pp. 289–394 (1975), which is incorporated herein by reference. In the hydrogen chemisorption technique, the amount of dispersion of the noble metal, such as Pt (platinum), is expressed in terms of the H/Pt ratio. An increase in the amount of hydrogen absorbed by a platinum containing catalyst will correspond to an increase in the H/Pt ratio. A higher H/Pt ratio corresponds to a higher platinum dispersion. Typically, an H/Pt value of greater than 1 indicates the average platinum particle size of a given catalyst is less than 1 nm. For example, an H/Pt value of 1.1 indicates the platinum particles within the catalyst form cluster sizes of less than about 10 Å. In the process of the invention, the H/Pt ratio can be greater than about 0.8, preferably between about 1.1 and 1.5. The H/noble metal ratio will vary based upon the hydrogen chemisorption stoichiometry. For example, if rhodium is used as the Group VIII noble metal component, the F/Rh ratio will be almost twice as high as the H/Pt ratio, i.e. greater than about 1.6, preferably between about 2.2 and 3.0. Regardless of which Group VIII noble metal is used, the noble metal cluster particle size should be less than about 10 Å.

The acidity of the catalyst can be measured by its Alpha Value, also called alpha acidity. The catalyst utilized in the process of the invention has an alpha acidity of less than about 1, preferably about 0.3 or less. The Alpha Value is an approximate indication of the SRO activity of the catalyst compared to a standard catalyst and it gives the relative rate constant (rate of normal hexane conversion per volume of catalyst per unit time). It is based on the activity of the highly active silica-alumina cracking catalyst which has an Alpha of 1 (Rate Constant=0.016 $sec^{-1}$). The test for alpha acidity is described in U.S. Pat. No. 3,354,078; in the Journal of Catalysis, 4, 527 (1965); 6, 278 (1966); 61, 395 (1980), each incorporated by reference as to that description. The experimental conditions of the test used therein include a constant temperature of 538° C. and a variable flow rate as described in the Journal of Catalysis, 61, 395 (1980).

Alpha acidity provides a measure of framework alumina. The reduction of alpha indicates that a portion of the framework aluminum is being lost. It should be understood that the silica to alumina ratio referred to in this specification is the structural or framework ratio, that is, the ratio of the $SiO_4$ to the $Al_2O_4$ tetrahedra which, together, constitute the structure of the crystalline sieve material. This ratio can vary according to the analytical procedure used for its determination. For example, a gross chemical analysis may include aluminum which is present in the form of cations associated with the acidic sites on the zeolite, thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain dealuminization treatments are employed which result in the presence of ionic aluminum free of the zeolite structure. Therefore, the alpha acidity should be determined in hydrogen form.

A number of different methods are known for increasing the structural silica:alumina ratios of various zeolites. Many of these methods rely upon the removal of aluminum from the structural framework of the zeolite employing suitable chemical agents. Specific methods for preparing dealuminized zeolites are described in the following to which reference may be made for specific details: "Catalysis by Zeolites" (International Symposium on Zeolites, Lyon, Sep. 9–11, 1980), Elsevier Scientific Publishing Co., Amsterdam, 1980 (dealuminization of zeolite Y with silicon tetrachloride); U.S. Pat. No. 3,442,795 and U.K. Pat. No. 1,058,188 (hydrolysis and removal of aluminum by chelation); U.K. Pat. No. 1,061,847 (acid extraction of aluminum); U.S. Pat. No 3,493,519 (aluminum removal by steaming and chelation); U.S. Pat. No. 3,591,488 (aluminum removal by steaming); U.S. Pat. No. 4,273,753 (dealuminization by silicon halide and oxyhalides); U.S. Pat. No. 3,691,099 (aluminum extraction with acid); U.S. Pat. No. 4,093,560 (dealuminization by treatment with salts); U.S. Pat. No. 3,937,791 (aluminum removal with Cr (III) solutions); U.S. Pat. No. 3,506,400 (steaming followed by chelation); U.S. Pat. No. 3,640,681 (extraction of aluminum with acetylacetonate followed by dehydroxylation); U.S. Pat. No. 3,836,561 (removal of aluminum with acid); German Offenleg. No. 2,510,740 (treatment of zeolite with chlorine or chlorine-containing gases at high temperatures), Dutch Pat. No. 7,604,264 (acid extraction), Japanese Pat. No. 53/101,003 ( treatment with EDTA or other materials to remove aluminum) and J.Catalysis, 54, 295 (1978) (hydrothermal treatment followed by acid extraction).

The preferred dealuminization method for preparing the crystalline molecular sieve material component in the process of the invention is steaming dealuminization, due to its convenience and low cost. More specifically, the preferred method is through steaming an already low acidic USY zeolite (e.g., alpha acidity of about 10 or less) to the level required by the process, i.e. an alpha acidity of less than 1.

Briefly, this method includes contacting the USY zeolite with steam at an elevated temperature of about 550 to about 815° C. for a period of time, e.g about 0.5 to about 24 hours sufficient for structural alumina to be displaced, thereby lowering the alpha acidity to the desired level of less than 1,preferably 0.3 or less. The alkaline cation exchange method is not preferred because it could introduce residual protons upon $H_2$ reduction during hydroprocessing, which may contribute unwanted acidity to the catalyst and also reduce the noble metal catalyzed hydrocracking activity.

The Group VIII metal component can be incorporated by any means known in the art. However, it should be noted that a noble metal component would not be incorporated into such a dealuminated crystalline sieve material under conventional exchange conditions because very few exchange sites exist for the noble metal cationic precursors.

The preferred methods of incorporating the Group VIII noble metal component onto the interior of the crystalline sieve material component are impregnation or cation exchange. The metal can be incorporated in the form of a cationic or neutral complex; $Pt(NH_3)_4^{2+}$ and cationic complexes of this type will be found convenient for exchanging metals onto the crystalline molecular sieve component. Anionic complexes are not preferred.

The steaming dealuminization process described above creates defect sites, also called hydroxyl nests, where the structural alumina has been removed. The formation of hydroxyl nests are described in Gao, Z. et. al., "Effect of Dealumination Defects on the Properties of Zeolite Y", J. Applied Catalysis, 56:1 pp. 83–94 (1989);Thakur, D., et. al., "Existence of Hydroxyl Nests in Acid-Extracted Mordenites," J.Catal., 24:1 pp. 543–6 (1972), which are incorporated herein by reference as to those descriptions. Hydroxyl nests can also be created by other dealumination processes listed above, such as acid leaching (see, Thakur et. al.), or can be created during synthesis of the crystalline molecular sieve material component.

In the preferred method of preparing the catalyst utilized in the process of the invention, the Group VIII noble metal component is introduced onto the interior sites of the crystalline molecular sieve material component via impregnation or cation exchange with the hydroxyl nest sites in a basic solution, preferably pH of from about 7.5 to 10, more preferably pH 8–9. The solution can be inorganic, such a $H_2O$, or organic such as alcohol. In this basic solution, the hydrogen on the hydroxyl nest sites can be replaced with the Group VIII noble metal containing cations, such as at $Pt(NH_3)_4^{2}+$.

After the Group VIII noble metal component is incorporated into the interior sites of the crystalline molecular sieve material, the aqueous solution is removed by drying at about 130–140° C. for several hours. The catalyst is then dry air calcined for several hours, preferably 3–4 hours, at a temperature of about 350° C.

To be useful in a reactor, the catalyst will need to be formed either into an extrudate, beads, pellets, or the like. To form the catalyst, an inert support can be used that will not induce acidity in the catalyst, such as self-and-or silica binding of the catalyst. A binder that is not inert, such as alumina, should not be used since aluminum could migrate from the binder and become re-inserted into the crystalline sieve material. This re-insertion can lead to creation of the undesirable acidity sites during the post steaming treatment.

The preferred low acidic SRO catalyst is a dealuminated Pt/USY catalyst. Heteroatoms, principally nitrogen and sulfur containing compounds, will greatly impair performance of the Pt/USY catalyst. These heteroatoms are typically contained in organic molecules within the pretreated hydrocarbon feed. Heteroatoms in organic compounds are more poisonous than in inorganic compounds. Also, at conditions where the Pt/USY catalyst is effective for catalyzing SRO, the same catalyst is also effective in catalyzing the conversion of organic heteroatoms to gaseous inorganic heteroatoms thereby releasing more $H_2S$ and $NH_3$ to partially impair its SRO activity.

Pretreating the hydrocarbon feed in order to eliminate heteroatoms is highly desirable in order to reduce heteroatom concentrations to the level the SRO catalyst can tolerate. Methods of eliminating heteroatoms from the feed include, but are not limited to, hydrotreatment, solvent extraction and chemical extraction. Any combination of these methods may be used to eliminate substantially all heteroatoms. Hydrotreatment is generally the preferred method of eliminating heteroatoms in the feed. But for heavier feeds, it is preferred to use solvent extraction to separate out heavy aromatic compounds.

There are three configurations for the inventive process. These are the counter-current, co-current and ebullated bed configurations. Based on ability to remove gaseous heteroatoms, the co-current configuration is preferred and the countercurrent configuration is most preferred. In the co-current configuration, the SRO catalyst can tolerate up to about 10 ppm of organic nitrogen and up to about 200 ppm of organic sulfur. In the counter-current configuration however, the SRO catalyst can tolerate up to about 50 ppm of organic nitrogen and up to about 500 ppm of organic sulfur.

In the co-current configuration, gaseous heteroatoms may be removed by an interstage stripper prior to having the feed contacting the Pt/USY catalyst. However, the use of an interstage stripper may not remove all heteroatoms that can impair the SRO catalyst.

To overcome SRO impairment by $H_2S$ and $NH_3$, the SRO catalyst in a cocurrent mode must normally run at higher temperatures to desorb the passivating heteroatom species and thus revive the SRO sites. But processing at higher temperatures (i.e. >620° F.) does bring about a few negative consequences. First, the residual acid sites from USY become active in catalyzing undesirable hydrocracking and hydroisomerization reactions. These reactions cause losses in diesel fuel yield and cetane number. Second, due to thermodynamic constraint, higher operation temperatures also favor retention and formation of undesirable aromatics and polynuclear aromatics (PNA) which also greatly lower fuel product quality.

In the counter-current configuration, the SRO catalyst can operate at its lowest possible temperature. Generally, heteroatoms that are converted from an organic into an inorganic form are removed from the gaseous phase. This removal is accomplished by a flow of hydrogen containing gas that forces the gaseous phase to flow counter to that of the liquid phase, thereby separating the gas that would normally flow with the liquid. In one embodiment, the apparatus for the inventive process has at least one first stage hydrotreating reactor in which the hydrocarbon feed is hydrotreated. After hydrotreatment, a downward stream of a liquid product effluent flows from the hydrotreating reactor towards a SRO reactor. A device, preferably connected to the SRO reactor, allows an upward stream of hydrogen containing gas to contact the downward stream of liquid product effluent and the SRO catalyst.

Thus, the counter-current configuration prevents heteroatom passivation of the SRO catalyst thereby allowing the catalyst to operate at the lowest possible temperature, owing to the flow of hydrogen containing gas that continuously cleans and preserves Pt active sites. The benefits of the counter-current configuration are therefore higher diesel yield and higher diesel cetane not achievable by using the co-current configuration.

The co-current configuration allows this process to operate with a low sulfur feed generally having less than about 600 ppm sulfur and less than about 50 ppm nitrogen. The countercurrent configuration can tolerate feeds with higher heteroatom content. Hydrotreated or hydrocracked feeds are preferred. Hydrotreating can saturate aromatics to naphthenes without substantial boiling range conversion and can remove poisons from the feed. Hydrocracking can also produce distillate streams rich in naphthenic species, as well as remove poisons from the feed.

Figure 7:
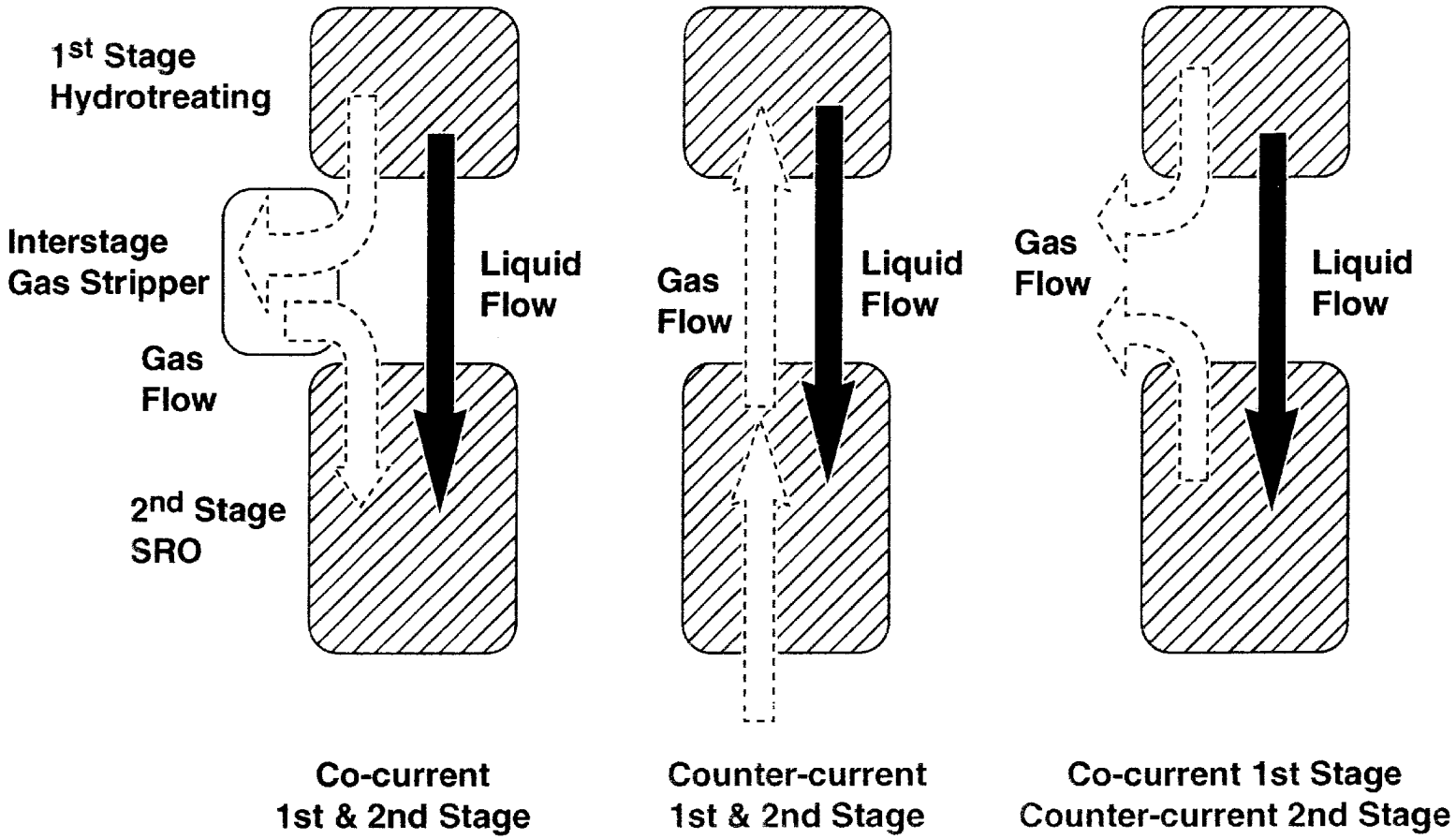
FIG. 7 is a diagram showing a preferred two stage configuration for practicing the present invention wherein the first stage is a co-current stage and the second stage is a counter-current stage.

A preferred configuration for practicing the present invention is to operate the present process in accordance with the FIG. 7 hereof. That is, the first stage, which is the hydrotreating stage for removing sulfur from the feed is operated in co-current mode and the second stage, which is the ring-opening stage is operated in counter-current mode.

Hydrotreating or hydrocracking the feedstock will usually improve catalyst performance and permit lower temperatures, higher space velocities, lower pressures, or combinations of these conditions, to be employed. Conventional hydrotreating or hydrocracking process conditions and catalysts known in the art can be employed.

The feedstock, preferably hydrotreated, is passed over the catalyst under superatmospheric hydrogen conditions. The space velocity of the feed is usually in the range of about 0.1 to about 10 LHSV, preferably about 0.3 to about 3.0 LHSV. The hydrogen circulation rate will vary depending on the paraffinic nature of the feed. A feedstock containing more paraffins and fewer ringed structures will consume less hydrogen. Generally, the hydrogen circulation rate can be from about 1400 to about 5600 SCF/bbl (250 to 1000 $n.1.1^{-1}$), more preferably from about 1685 to about 4500 SCF/bbl (300 to 800 $n.1.1^{-1}$). Pressure ranges will vary from about 400 to about 1000 psi, preferably about 600 to about 800 psi.

Reaction temperatures in a co-current scheme will range from about 550 to about 700° F. (about 288 to about 370° C.) depending on the feedstock. Heavier feeds or feeds with higher amounts of nitrogen or sulfur will require higher temperatures to desorb them from the catalyst. At temperatures above 700° F., significant diesel yield loss will occur. The ideal reaction temperature in the co-current scheme is about 652° F. (about 330° C.). Reaction temperatures in a counter-current scheme can be lower depending on how much organic heteroatoms were converted to their gaseous form before the feed reaches the catalyst. When substantially all organic heteroatoms have been converted to their gaseous form and thereafter removed, the temperature can be from about 544 to about 562° F. (from about 270 to about 280° C.).

The properties of the feedstock will vary according to whether the feedstock is being hydroprocessed to form a high cetane diesel fuel, or whether low cetane diesel fuel is being upgraded to high cetane diesel fuel.

The feedstocks to be hydroprocessed to a diesel fuel product can generally be described as high boiling point feeds of petroleum origin. In general, the feeds used in the co-current configuration will have a boiling point range of about 350 to about 750° F. (about 175 to about 400° C.), preferably about 400 to about 700° F. (about 205 to about 370° C.). Generally, the preferred feedstocks are non-thermocracked streams, such as gasoils distilled from various petroleum sources. Catalytic cracking cycle oils, including light cycle oil (LCO) and heavy cycle oil (HCO), clarified slurry oil (CSO) and other catalytically cracked products are potential sources of feeds for the present process. If used, it is preferred that these cycle oils make up a minor component of the feed. Cycle oils from catalytic cracking processes typically have a boiling range of about 400 to 750° F. (about 205 to 400° C.), although light cycle oils may have a lower end point, e.g. 600 or 650° F. (about 315° C. or 345° C.). Because of the high content of aromatics and poisons such as nitrogen and sulfur found in such cycle oils, they require more severe process conditions, thereby causing a loss of distillate product. Lighter feeds may also be used, e.g. about 250° F. to about 400° F. (about 120 to about 205° C.). However, the use of lighter feeds will result in the production of lighter distillate products, such as kerosene. Feedstocks to be used in the counter-current configuration can generally tolerate dirtier feeds.

The feed to the process is rich in naphthenic species. The naphthenic content of the feeds used in the present process generally will be at least 5 weight percent, usually at least 20 weight percent, and in many cases at least 50 weight percent. The balance will be divided among n-paraffins and aromatics according to the origin of the feed and its previous processing. The feedstock should not contain more than 50 weight percent of aromatic species, preferably less than 40 weight percent.

A low cetane diesel fuel can be upgraded by the process of the invention. Such a feedstock will have a boiling point range within the diesel fuel range of about 400 to about 750° F. (about 205 to about 400 ° C.).

The feeds will generally be made up of naphthenic species and high molecular weight aromatics, as well as long chain paraffins. The fused ring aromatics are selectively hydrogenated and then cracked open during the process of the invention by the highly dispersed metal function on the catalyst due to the affinity of the catalyst for aromatic and naphthenic structures. The unique selectivity of the catalyst minimizes secondary hydrocracking and hydroisomerization of paraffins. The present process is, therefore, notable for its ability to upgrade cetane numbers, while minimizing cracking of the beneficial distillate range paraffins to naphtha and gaseous by-products.

The following examples are provided to assist in a further understanding of the invention. The particular materials and conditions employed are intended to be further illustrative of the invention and are not limiting upon the reasonable scope thereof.

EXAMPLE 1

This example illustrates the preparation of an SRO catalyst possessing an alpha acidity below the minimum required by the process of this invention. Commercial TOSOH 390 USY (alpha acidity of about 5) was steamed at 1025° F. for 16 hours. X-ray diffraction showed an excellent crystallinity retention of the steamed sample. n-Hexane, cyclo-hexane, and water sorption capacity measurements revealed a highly hydrophobic nature of the resultant siliceous large pore zeolite. The properties of the severely dealuminated USY are summarized in Table 1.

TABLE 1

Properties of Dealuminated USY

| PROPERTY | VALUE |
|---|---|
| Zeolite Unit Cell Size | 2423 Å |
| Na | 115 ppm |
| n-Hexane Sorption Capacity | 19.4% |
| cyclo-Hexane Sorption Capacity | 21.4% |
| Water Sorption Capacity | 3.1% |
| Zeolite Acidity, α | 0.3 |

0.6 wt % of Pt was introduced onto the USY zeolite by cation exchange technique, using $Pt(NH_3)_4(OH)_2$ as the precursor. During the exchange in a pH 8.5–9.0 aqueous solution, $Pt(NH_3)_4^{+2}$ cation replaced $H^+$ associated with the zeolitic silanol groups and hydroxyl nests. Afterwards, excess water rinse was applied to the Pt exchanged zeolite material to demonstrate the extra high $Pt(NH_3)_4^{+2}$ cation exchange capacity of this highly siliceous USY. The water was then removed at 130° C. for 4 hours. Upon dry air calcination at 350° C. for 4 hours, the resulting catalyst had an H/Pt ratio of 1.12, determined by standard hydrogen chemisorption procedure. The chemisorption result indicated that the dealuminated USY zeolite supported highly dispersed Pt particles (i.e. <10 Å). The properties of the resulting SRO catalysts are set forth in Table 2 below.

TABLE 2

SRO Catalyst Properties

| PROPERTY | VALUE |
|---|---|
| H/Pt Ratio | 1.12 |
| Pt Content | 0.60% |

EXAMPLE 2

This example illustrates the process in a co-current configuration for selectively upgrading hydrocracker recycle splitter bottoms to obtain a product having an increased cetane content. The properties of the hydrocracker recycle splitter bottoms are set forth in Table 3.

TABLE 3

Properties of Feedstock

| PROPERTY | VALUE |
|---|---|
| API Gravity @60° F. | 39.3 |
| Sulfur, ppm | 1.5 |
| Nitrogen, ppm | <0.5 |
| Aniline Point, ° C. | 89.6 |
| Aromatics, wt % | 12.7 |
| Refractive Index | 1.43776 |
| Pour Point, ° C. | 9 |
| Cloud Point, ° C. | 24 |
| Simdis, ° F. (D2887) | |
| IBP | 368 |
| 5% | 414 |
| 10% | 440 |
| 30% | 528 |
| 50% | 587 |
| 70% | 649 |
| 90% | 736 |
| 95% | 776 |
| EP | 888 |

The reactor was loaded with catalyst and vycor chips in a 1:1 ratio. The catalyst was purged with a 10:1 volume ratio of $N_2$ to catalyst per minute for 2 hrs at 177° C. The catalyst was reduced under 4.4:1 volume ratio of $H_2$ to catalyst per minute at 260° C. and 600 psi for 2 hrs. The feedstock was then introduced.

The reaction was performed at 600 psig, 4400 SCF/bbl $H_2$ circulation rate and 0.4 LHSV (0.9 WHSV). Reaction temperatures ranged from 550 to 650° F.

Figure 2:
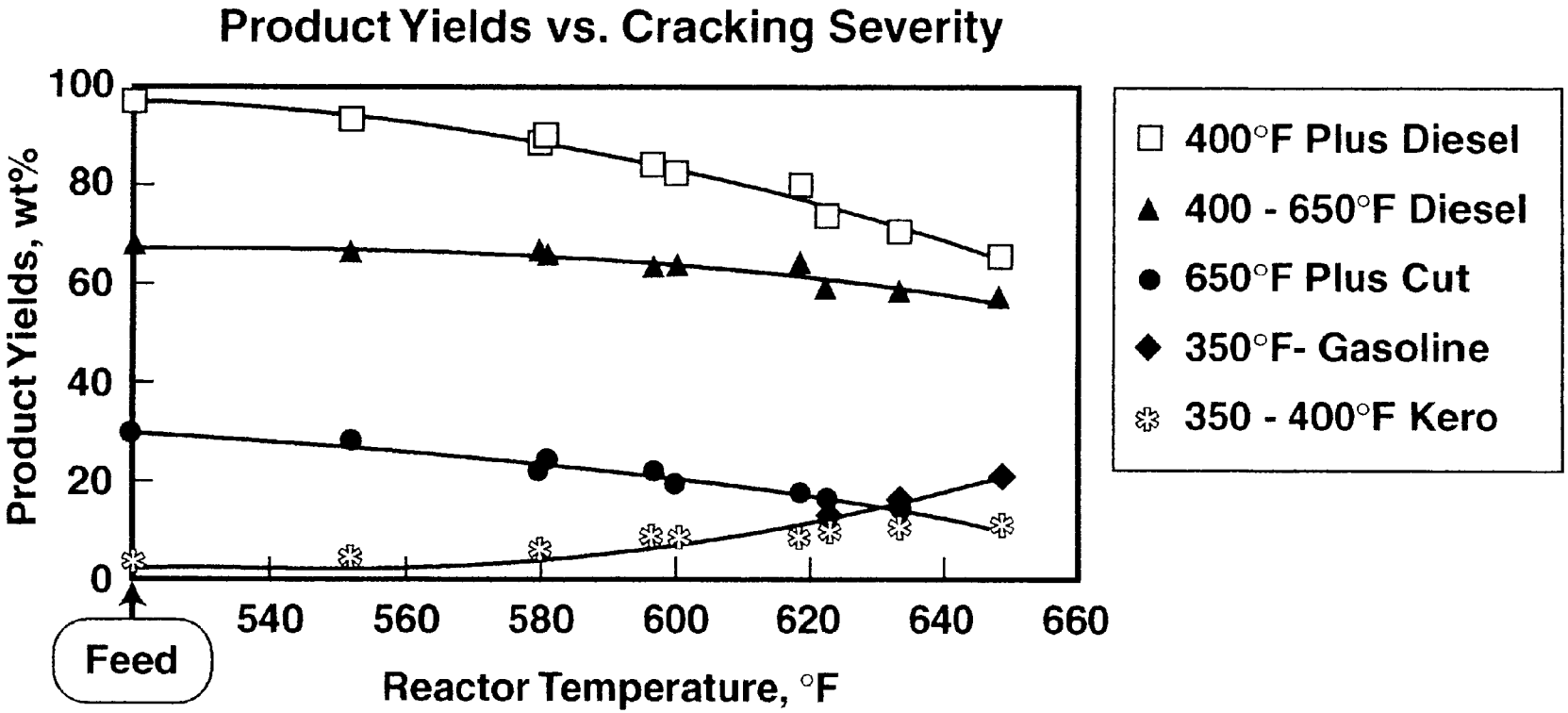

FIG. 1 demonstrates the selectivity of the catalyst in cracking the 650° F.$^+$ heavy ends as opposed to the 400° F.$^{30}$ diesel front ends. For example, at 649° F., the catalyst converts 69 vs. 32% of 650° F.$^+$, and 400° F.$^+$, respectively. FIG. 2 shows the 400–650° F. diesel yields vs. cracking severity. At temperatures where extensive heavy-end cracking occurs (i.e. greater than 650° F.), the 400–650° F. diesel yields range from 56–63% in a descending order of reaction severity compared to a yield of 67% with the unconverted feed. The portion of 650° F.$^+$ bottoms contracts from 30% as existing in the feed to less than 9% at the highest severity tested, 649° F. Thus, the catalyst retains high diesel yields (i.e. 84–94%) while selectively converting the heavy ends.

Figure 3:
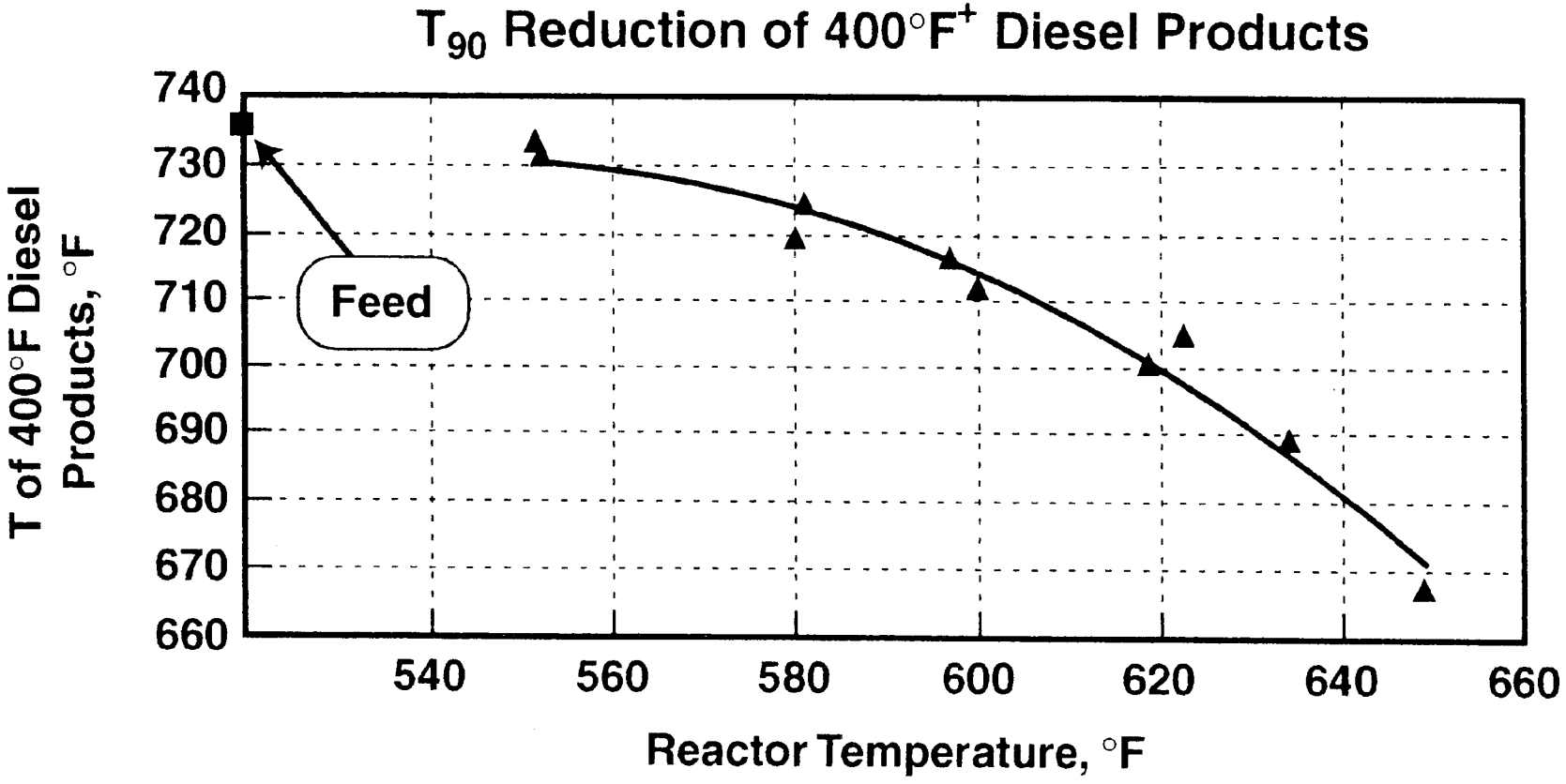
Figure 4:
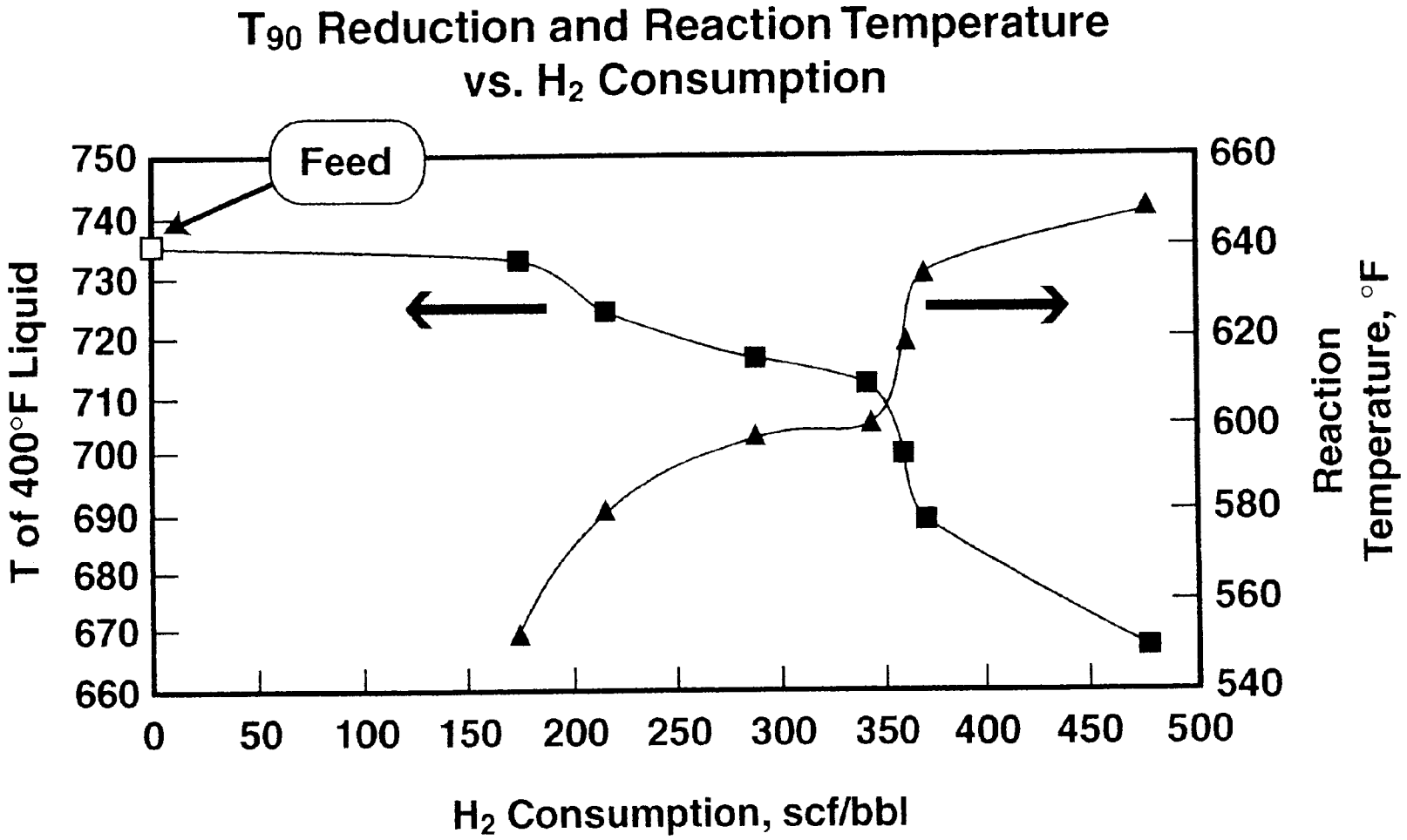

FIG. 3 shows Tgo of the converted 400° F.$^+$ liquid products. Reduction of $T_{90}$ from 736° F. observed with the feed to 719° F. by processing at 580° F. is mostly due to aromatic saturation. Treating at temperatures higher than 580° F. results in further $T_{90}$ reduction. This is attributed to back end hydrocracking, mild hydroisomerization, and finally, ring opening of naphthenic intermediates. This process reaction is further demonstrated in FIG. 4 which shows four distinct $H_2$ consumption rates and $T_{90}$ reduction domains at temperature ranges of 550–580, 580–600, 600–630, and 630° F.$^+$. The results indicate the complicated nature of the reactions. FIG. 4 shows aromatic saturation occurring at 550–580° F. and back-end cracking occurring at 580–600° F. At 600–630° F., some mild hydroisomerization occurs on paraffins and naphthenic rings which result in further $T_{90}$ reduction, yet consume little hydrogen. In this range, due to higher temperature, low pressure, and also the lack of naphthenic ring opening activity, some aromatics start to reappear via dehydrogenation of naphthenic species. However, at temperatures exceeding 630° F., the competing naphthenic ring opening reaction commences rendering more hydrogen consumption, more $T_{90}$ reduction, and greater cetane enhancement.

EXAMPLE 3

Figure 5:
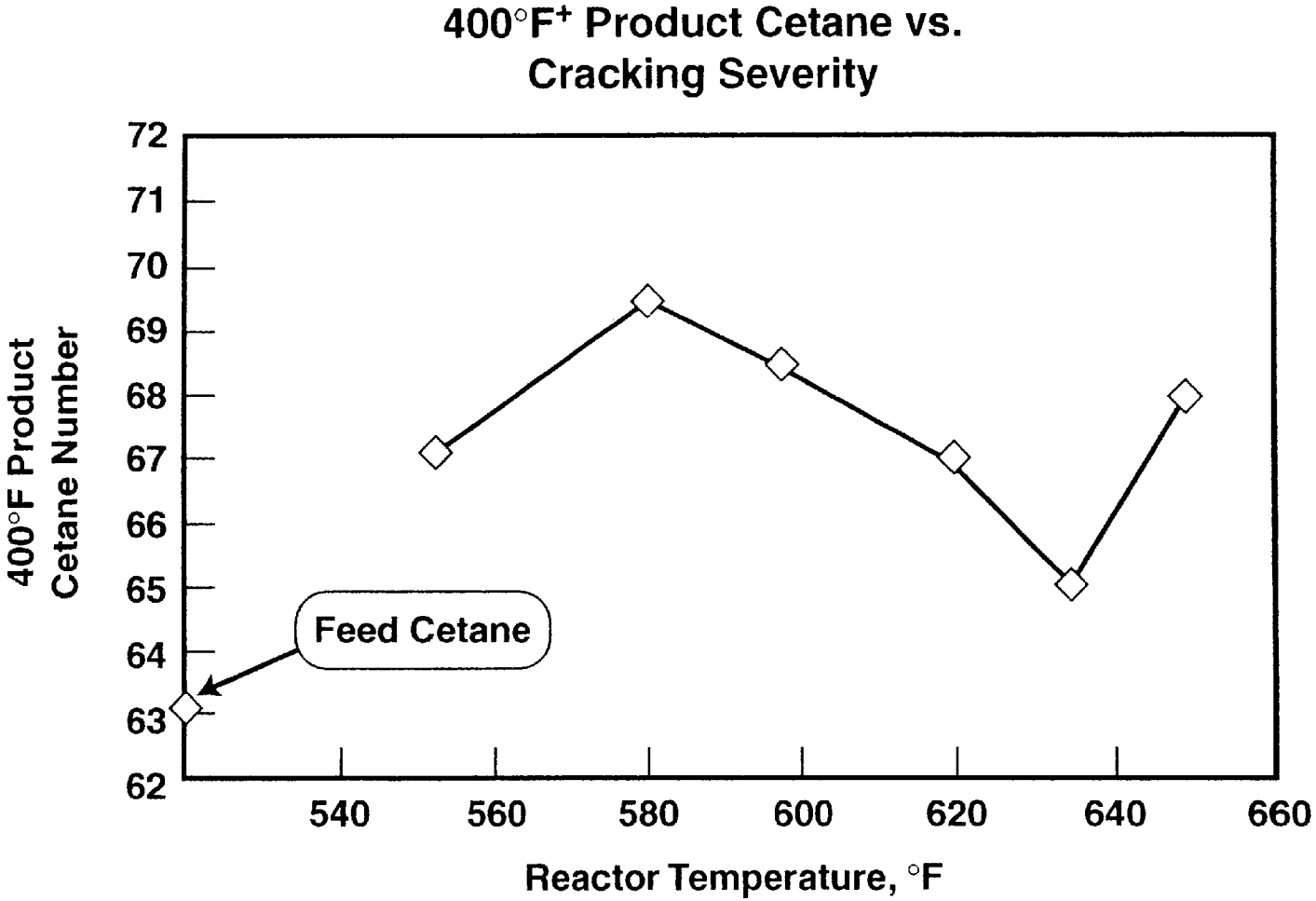

This example illustrates the increased cetane levels resulting from the process of the invention in the co-current configuration. FIG. 5 shows the cetane levels of the 400° F.$^+$ products with respect to reaction temperature. Table 4 gives a correlation of various 400° F.$^+$ and 650° F.$^+$ conversions with cetane of the 400° F.$^+$ products.

TABLE 4

Cetane Number vs. Front-End and Back-End Conversions

| | | Reaction Temperature | | | | | |
|---|---|---|---|---|---|---|---|
| | Feed | 550° F. | 580° F. | 597° F. | 619° F. | 634° F. | 649° F. |
| 400° F.$^+$ Conversion (wt %) | | 3.8 | 8.6 | 13.2 | 17.2 | 25.9 | 31.8 |
| 650° F.$^+$ Conversion (wt %) | | 8.0 | 25.8 | 28.0 | 44.1 | 55.5 | 69.5 |
| Cetane Number of 400° F.$^+$ Products | 63.2 | 67.1 | 69.4 | 68.6 | 67.0 | 65.0 | 67.9 |

At reaction temperatures of 550–580° F., because of aromatic saturation, product cetane increases to 67–69, compared to 63 with the feed. At the higher temperatures between 580–630° F., because of a molecular weight reduction induced by back-end hydrocracking and also by a mild extent of hydroisomerization, cetane numbers gradually drop from 69–66. Finally, at 630° F.$^+$, due to naphthenic ring opening, product cetane increases again to 68.Overall, product cetanes stay above the feed cetane of 63, while continuing end point reduction.

EXAMPLE 4

Figure 6:
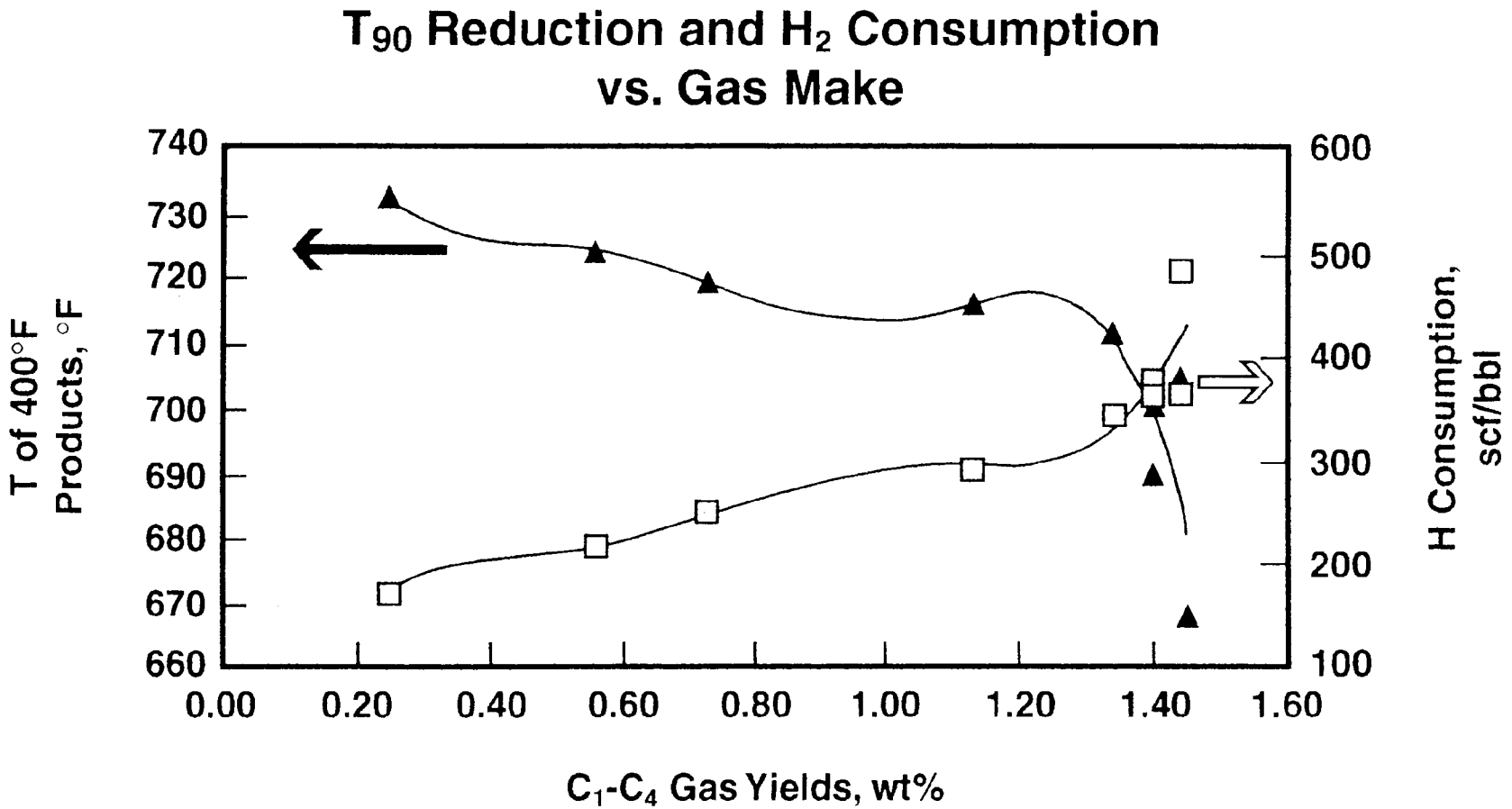

This example illustrates the low production of gases from the process of the invention in a co-current configuration throughout the range of reaction temperature as demonstrated in FIG. 6. Up to 600° F., the reaction makes between 0.2 and 1.4 wt % of $C_1$–$C_4$. At temperatures greater than 600° F., the amount of gas made by the process appears to level off at ~1.4%. FIG. 6 shows that when $T_{90}$ of 400° F.$^+$ products is reduced from 710 to 690° F. (i.e. at reactor temperatures of 600–630–° F.), the gas yields level off at ~1.4 wt %, whereas $H_2$ consumption is greatly enhanced. This demonstrates the selective ring opening of naphthenes occurring at about 630° F., without making gaseous fragments. The reaction is distinctly different from that typically observed with other well known noble metal catalyzed hydrocracking catalysts where, due to a high temperature requirement (normally at >850° F.), methane is the predominant product.

EXAMPLE 5

A Pt/USY catalyst whose properties are listed in Table 2 was compared with a catalyst that has equivalent Pt content and dispersion, but does not contain the metal support properties required by the process. The catalyst used as a comparison is Pt/Alumina having an alpha acidity of less than 1. Both catalysts were contacted with a feedstock in a co-current configuration at a temperature of 680° F., 800 psig, WHSV 1.0, and $H_2$/Feed mole ratio of 6.0.

Table 5 contains the properties of both the feedstock and the product properties resulting from each of the catalysts. The example demonstrates the remarkable ring opening selectivity of Pt/USY, 96.6 wt % vs. the ring opening selectivity of Pt/Alumina, 0.0 wt %. Total ring opening conversion was 53.8 wt % for Pt/USY vs. 1.2 wt % for Pt/Alumina. These figures demonstrate how the process of the invention selectively opens the ringed structures to increase the paraffins necessary to produce a high cetane diesel fuel.

TABLE 5

Ring Opening Over Pt/USY and Pt/Alumina

| Catalyst<br>Product Dist., wt % | (Feed) | Pt/USY | (Feed) | Pt/<br>Alumina |
|---|---|---|---|---|
| C4 Paraffins | | 0.2 | | 1.0 |
| C5–C9 Paraffins | | 2.1 | | 2.9 |
| C10–C13 Paraffins | | — | | 0.9 |
| C10+-Alkylnaphthenes (C10–C11) | | 36.7 | | 0.0 |
| Decalin (+trace tetralin) | 60.0 | 31.7 | 63.0 | 62.4 |
| 1-Methyldecalin | | 0.9 | | 9.3 |
| 1-Methylnaphthalene | 10.6 | 0.0 | 10.7 | 1.1 |
| 1-Tetradecanes | | 12.7 | | 10.1 |
| n-Tetradecane | 29.4 | 15.7 | 27.1 | 12.4 |
| Total Ring Opening Conversion, wt % | | 53.8 | | 1.2 |
| Decalin Conversion, wt % | | 47.2 | | 1.0 |
| 1-Methylnaphthalene Conv., wt % | | 100.0 | | 89.7 |
| (1-MN + 1-M Decalin) Conv., wt % | | 91.2 | | 2.8 |
| n-Tetradecane Conversion, wt % | | 46.7 | | 54.2 |
| Ring Opening Selectivity, wt % | | 96.6 | | 0.0 |

Therefore, the process of the invention in a co-current configuration is capable of producing high cetane diesel fuels in high yield by a combination of selective heavy ends hydrocracking and naphthenic ring opening. More specifically, at 580–630° F., back-end cracking occurs with minimal hydroisomerization to form multiply branched isoparaffins. When temperature exceeds 630° F., the catalyst becomes active in catalyzing selective ring opening of naphthenic species, boosting product cetane. Ring opening selectivity stems from stronger adsorption of naphthenes than paraffins over the catalyst. Using hydrocracker recycle sputter bottoms as a heavy endpoint distillate feed, the process maintained higher product cetane in all of the lower molecular weight diesels than that of the feed, while co-producing very little gas and retaining 95+% kerosene and diesel yields.

EXAMPLE 6

This example compares the co-current and counter-current configurations. FIG. 7 illustrates these different configurations.

For both configurations, a distillate stream in a first-stage reactor was hydrotreated to yield a $C_5^+$ liquid product containing organic S and N of 50 and 1 ppm, respectively, and aromatics of 32 wt %. Taken as a reference, the liquid effluent was admixed with a hydrogen containing gas containing 530 and 20 ppm of $H_2S$ and $NH_3$ respectively. The liquid effluent and gas was then introduced counter-currently into a second stage reactor containing a Pt/USY-SRO catalyst. For comparison, the gaseous heteroatoms were flowed co-currently over the SRO bed inside the second stage reactor at the same total levels of 530-ppm S and 20-ppm N. However, in the second case, pure $H_2$ was introduced counter-currently through the bottom of the second-stage SRO reactor. Table 6 shows the comparison of the resultant diesel products between the two schemes.

TABLE 6

Performance of Co-current vs. Counter-current Configuration

| Operation Mode | Co-current | | | Counter-current |
|---|---|---|---|---|
| Reactor Temperature, ° F. | 580 | 620 | 639 | 614 |
| 400° F.+ Conversion, wt % | 15.5 | 37.0 | 53.4 | 33.4 |
| 650° F.+ Conversion, wt % | 31.7 | 68.5 | 91.9 | 67.0 |
| 400–650° F. Diesel | | | | |
| Yield, wt % | 58.9 | 45.7 | 35.2 | 50.4 |
| Cetane Number | 51 | 52 | 60 | 58 |
| Aromatics, wt % | 12.4 | 8.1 | 5.7 | 3.0 |
| C1–C4 Gas Yield, wt % | 0.6 | 2.6 | 3.4 | 2.2 |

Conditions: 800 psig H2, LHSV 2, H2 circulation 4000 scf/bbl
All liquid Products contain 1 ppmw S and <0.5 ppm N.

The counter-current configuration at a reaction temperature of 614° F. achieved a higher cetane number than the co-current configuration did at a higher reaction temperature of 620° F. This was due to less hydrocracking and hydroisomerization of paraffins. In addition, a greater diesel yield of 50.4% was obtained when operating the SRO catalyst in a counter-current configuration at 614° F. as opposed to the co-current configuration at 620° F. and 639° F. Thus, higher diesel yield and higher cetane number can be achieved by operating the SRO catalyst at lower reaction temperatures using the counter-current configuration which cannot be achieved using the co-current configuration.

While there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. A two stage process for selectively producing diesel fuels from a hydrocarbon feed which process comprises:

(a) contacting said hydrocarbon feed in a first stage reactor with a hydrogen containing gas thereby producing a liquid product effluent; and (b) contacting said liquid product effluent in a second stage reactor in a counter-current configuration under superatmospheric conditions with a selective ring-opening catalyst comprising:

a large pore crystalline molecular sieve material component having a faujasite structure and an alpha acidity of less than 1, and a group VIII noble metal component.

2. The process as described in claim 1 wherein the said hydrocarbon feed in the first stage reactor is in a co-current, counter-current, or an ebullated bed configuration.

3. The process in claim 2 wherein the said hydrocarbon feed in the first stage reactor is in a co-current configuration with a hydrogen containing gas.

4. The process as described in claim 1 wherein said crystalline sieve material component is zeolite USY.

5. The process as described in claim 1 wherein said alpha acidity is about 0.3 or less.

6. The process as described in claim 1 wherein said Group VIII noble metal component is selected from the elemental group consisting of platinum, palladium, iridium, and rhodium, or a combination thereof.

7. The process as described in claim 6 wherein said Group VIII noble metal component is platinum.

8. The process as described in claim 1 wherein the particle size of said Group VIII noble metal component is less than about 10 Å.

9. The process as described in claim 1 wherein the content of said Group VIII noble metal component is between 0.1 and 5 wt % of said catalyst.

10. The process as described in claim 7 wherein the said platinum is dispersed on said crystalline molecular sieve component, said dispersion being characterized by an H/Pt ratio of between 1.1 and 1.5.

11. The process as described in claim 1 wherein said liquid product effluent is contacted with said catalyst at a pressure from about 400 to about 1000psi H2, a temperature from about 544° F. to about 700° F., a space velocity of about 0.3 to about 3.0 LHSV, and a hydrogen circulation rate of about 1400 to about 5600 SCF/bbl.

12. A two stage process for selectively producing diesel fuels from a hydrocarbon feed which process comprises:

(a) contacting said hydrocarbon feed in a first stage reactor with a hydrogen containing gas in a co-current configuration thereby producing a liquid product effluent; and (b) contacting said liquid product effluent in a second stage reactor in a counter-current configuration under superatmospheric conditions with a selective ring-opening catalyst comprising:

a large pore crystalline molecular sieve material component having a faujasite structure and an alpha acidity of less than 1, and a group VIII noble metal component.

13. The process as described in claim 12 wherein said crystalline sieve material component is zeolite USY.

14. The process as described in claim 12 wherein said alpha acidity is about 0.3 or less.

15. The process as described in claim 12 wherein said Group VIII noble metal component is selected from the elemental group consisting of platinum, palladium, iridium, and rhodium, or a combination thereof.

16. The process as described in claim 15 wherein said Group VIII noble metal component is platinum.

17. The process as described in claim 12 wherein the particle size of said Group VIII noble metal component is less than about 10 Å.

18. The process as described in claim 12 wherein the content of said Group VIII noble metal component is between 0.1 and 5 wt. % of said catalyst.

19. The process as described in claim 16 wherein the platinum is dispersed on said crystalline molecular sieve component, said dispersion being characterized by an H/Pt ratio of between 1.1 and 1.5.

20. The process as described in claim 12 wherein said liquid product effluent is contacted with said catalyst at a pressure from about 400 to about 1000 psi H2, a temperature from about 544° F. to about 700° F., a space velocity of about 0.3 to about 3.0 LHSV, and a hydrogen circulation rate of about 1400 to about 5600 SCF/bbl.

* * * * *

UNITED STATES PATENT AND TRADEMARK OFFICE

CERTIFICATE OF CORRECTION

PATENT NO. : 6,500,329 B2 
DATED : December 31, 2002
INVENTOR(S) : Tsao et al.

It is certified that error appears in the above-identified patent and that said Letters Patent is hereby corrected as shown below:

Drawings,
Figure 3, the y-axis "T" should read -- $T_{90}$ --; and "400ºF" should read -- 400ºF$^+$ --.
Figure 4, the y-axis "T" should read -- $T_{90}$ --.
Figure 5, the y-axis "400ºF" should read -- 400ºF$^+$ --.
Figure 6, the left-axis "T" should read -- $T_{90}$ --; and the right-axis "H" should read -- $H_2$ --.

Column 14,
Line 56, "sputter" should read -- splitter --.

Signed and Sealed this

Twenty-seventh Day of May, 2003

JAMES E. ROGAN
*Director of the United States Patent and Trademark Office*